US008424470B2

(12) United States Patent
Volin

(10) Patent No.: US 8,424,470 B2
(45) Date of Patent: Apr. 23, 2013

(54) UNIQUE FOLDABLE TABLE HAVING AUTOMATIC BUTTON-LATCHING AND BUTTON-RELEASING SYSTEM, AUTOMATIC LEG-CENTERING SYSTEM, AND AUTOMATIC COLLAPSE-PREVENTING SYSTEM

(76) Inventor: Dee Volin, Fairview, OR (US)

( * ) Notice: Subject to any disclaimer, the term of this patent is extended or adjusted under 35 U.S.C. 154(b) by 10 days.

(21) Appl. No.: 13/134,162

(22) Filed: May 31, 2011

(65) Prior Publication Data

US 2012/0304901 A1 Dec. 6, 2012

(51) Int. Cl.
*A47B 3/02* (2006.01)

(52) U.S. Cl.
USPC ..... 108/118

(58) Field of Classification Search ..... 108/115, 108/118, 119, 120, 153.1, 157.1; 248/188, 248/188.1, 188.6, 188.7, 432, 164, 166; 297/16.2, 297/163.1, 16.1
See application file for complete search history.

(56) References Cited

U.S. PATENT DOCUMENTS

| | | | | |
|---|---|---|---|---|
| 2,618,524 | A | 11/1952 | Hoffmann | |
| 3,646,895 | A | 3/1972 | Campbell | |
| 4,262,606 | A | 4/1981 | Hodson | |
| 5,243,803 | A | 9/1993 | Tabata et al. | |
| 5,421,273 | A | 6/1995 | Lin | |
| 5,435,510 | A | 7/1995 | Wey | |
| 5,645,259 | A | 7/1997 | Chen | |
| 5,865,127 | A * | 2/1999 | Carter | 108/115 |
| 5,884,566 | A | 3/1999 | Chen | |
| 6,026,751 | A | 2/2000 | Tsai | |
| 6,073,894 | A | 6/2000 | Chen | |
| 6,079,338 | A | 6/2000 | Yeh | |
| 6,082,813 | A * | 7/2000 | Chen | 297/16.2 |
| 6,125,769 | A | 10/2000 | Tsai et al. | |
| 6,158,361 | A | 12/2000 | Zheng et al. | |
| 6,193,308 | B1 | 2/2001 | Hwang | |
| 6,199,489 | B1 | 3/2001 | Tsai | |
| 6,234,089 | B1 | 5/2001 | Zheng et al. | |
| 6,283,045 | B1 | 9/2001 | Izumi | |
| 6,505,565 | B1 | 1/2003 | Byung et al. | |
| 6,575,422 | B1 | 6/2003 | Zheng | |
| 6,640,730 | B2 | 11/2003 | Tsai | |
| 6,722,293 | B2 | 4/2004 | Lee | |
| 6,920,834 | B1 | 7/2005 | Pehta et al. | |
| 6,929,230 | B2 | 8/2005 | Tsai | |
| 6,997,111 | B2 | 2/2006 | Giegerich | |
| 7,131,364 | B2 * | 11/2006 | Brazell | 108/118 |
| 7,229,128 | B2 * | 6/2007 | Lee | 297/16.2 |
| 7,543,614 | B2 | 6/2009 | Wise | |
| 7,604,289 | B2 | 10/2009 | Chen | |
| 2004/0051009 | A1 * | 3/2004 | Chen | 248/163.1 |
| 2004/0084581 | A1 * | 5/2004 | Chang | 248/166 |
| 2006/0107879 | A1 * | 5/2006 | Hsieh | 108/118 |
| 2009/0241811 | A1 * | 10/2009 | Markegard et al. | 108/118 |

* cited by examiner

*Primary Examiner* — Jose V Chen

(57) ABSTRACT

A unique foldable table comprises a collapse-preventing tabletop assembly, a plurality of extendable-leg assemblies releasably attached to the tabletop assembly, and a plurality of scissoring-arm assemblies attached to the extendable-leg assemblies, respectively. The collapse-preventing tabletop assembly has an automatic collapse-preventing system of clamps for automatically cross-interlocking the tabletop and the extendable-leg assemblies to prevent the unique foldable table from folding inwards and collapsing. The extendable-leg assemblies have: an automatic button-latching and button-releasing system of spring-loaded latches for automatically latching and automatically releasing the release buttons to simplify the cumbersome, two-handed table operation into an easy, one-handed table operation to eliminate the risk of personal injury; and an automatic leg-centering system of leg-centering clamps for automatically centering and clamping the extendable-leg assemblies to lock them in place.

20 Claims, 17 Drawing Sheets

UNIQUE FOLDABLE TABLE HAVING AUTOMATIC BUTTON-LATCHING AND BUTTON-RELEASING SYSTEM, AUTOMATIC LEG-CENTERING SYSTEM, AND AUTOMATIC COLLAPSE-PREVENTING SYSTEM

BACKGROUND OF THE INVENTION

1. Field of the Invention

The present invention relates to a foldable table, which is easy, convenient, and safe to fold and unfold, and which is strong, durable, and safe to use. Particularly, the present invention relates to a foldable table having an automatic button-latching and button-releasing system, an automatic leg-centering system, and an automatic collapse-preventing system.

2. Description of the Prior Art

A number of foldable and collapsible tables and frames have been introduced. U.S. Pat. No. 2,618,524, filed Nov. 30, 1949, to C. Hoffmann; U.S. Pat. No. 3,646,895, filed Sep. 2, 1970, to Richard B. Campbell; U.S. Pat. No. 4,262,606, filed Jan. 2, 1979, to Hollis C. Hodson; U.S. Pat. No. 5,243,803, filed Nov. 30, 1992, to Tabata; U.S. Pat. No. 5,421,273, filed Mar. 14, 1994, to Yuan-Hsiung Lin; U.S. Pat. No. 5,435,510, filed Dec. 23, 1993, to Louis Wey; U.S. Pat. No. 5,645,259, filed Jun. 21, 1996, to Kao-San Chen; U.S. Pat. No. 5,865,127, filed Mar. 24, 1998, to Mark C. Carter; U.S. Pat. No. 5,884,566, filed Jul. 2, 1997, to Kao-San Chen; U.S. Pat. No. 6,026,751, filed Dec. 31, 1998, to Ming-Liang Tsai; U.S. Pat. No. 6,073,894, filed Mar. 18, 1998, to Kao-San Chen; U.S. Pat. No. 6,079,338, filed Aug. 23, 1999, to Chin-Chung Yeh; U.S. Pat. No. 6,125,769, filed Aug. 4, 1999, to Ting-sheng Tsai; U.S. Pat. No. 6,158,361, filed Apr. 30, 1999, to Edward Zheng; U.S. Pat. No. 6,193,308, filed Aug. 3, 1999, to Joo-Hwan Hwang; U.S. Pat. No. 6,199,489, filed Jan. 7, 2000, to Ting-Sheng Tsai; U.S. Pat. No. 6,234,089, filed Jun. 29, 1999, to Edward Zheng; U.S. Pat. No. 6,283,045, filed Jan. 24, 2000, to Satoshi Izumi; U.S. Pat. No. 6,505,565, filed Mar. 28, 2000, to Choi Sang Byung; U.S. Pat. No. 6,575,422, filed Dec. 18, 2000, to Edward Zheng; U.S. Pat. No. 6,640,730, filed Dec. 6, 2001, to Ming-Liang Tsai; U.S. Pat. No. 6,722,293, filed Sep. 26, 2002, to Yu-Shu Lee; U.S. Pat. No. 6,920,834, filed Feb. 7, 2003, to John A. Pehta; U.S. Pat. No. 6,929,230, filed Oct. 17, 2003, to Ming-Liang Tsai; U.S. Pat. No. 6,997,111, filed Oct. 31, 2003, to Paul Giegerich; U.S. Pat. No. 7,543,614, filed Mar. 13, 2007, to Robert W. Wise; and U.S. Pat. No. 7,604,289, filed Dec. 4, 2007, to Libin Chen disclose a variety of inventions related to foldable and collapsible tables and frames. The prior art has failed to solve many problems associated with such foldable and collapsible tables and frames, as follows:

No prior art offers or discloses any foldable table having automatic button-latching and button-releasing system, automatic leg-centering system, and automatic collapse-preventing system.

No prior art offers or discloses any automatic button-latching and button-releasing system. As a result, no prior-art table can be automatically activated to fold with a simple push of each of the release buttons of the table.

No prior art offers or discloses any automatic button-latching and button-releasing system. As a result, instead of an easy, one-handed operation, all the prior-art foldable tables require a cumbersome, two-handed operation to be folded.

To unlock each locking sleeve of the prior-art tables to fold them up, all the prior art requires two simultaneous actions of: a) Pressing the release button of one locking sleeve with one hand, and b) At the same time, pressing the frame of the table downwards with another hand, to stretch the frame to keep the locking sleeve in an "unlocking position".

All prior art requires the need to stretch the frames of the tables to unlock the tables each time the tables are folded. This results in quickly weakening the structural strength of and quickly shortening the service lifespan of the frames of the tables over time.

No prior art offers or discloses any automatic leg-centering system to automatically prevent the extendable-leg assemblies of all prior art from wobbling. As a result, the extendable-leg assemblies of all prior art wobble and quickly weaken the structural strength of and quickly shorten the service lifespan of the frames of the tables over time.

No prior art offers or discloses any automatic collapse-preventing system to strengthen the entire structure of the tables while in use. As a result, all prior art has experienced a decreased tolerance and durability of the structure of the tables as well as a shortened lifespan thereof.

No prior art offers or discloses any automatic collapse-preventing system to automatically cross-interlock the removable tabletop and all the extendable-leg assemblies of the tables to prevent the tables from folding inwards and, thus, collapsing. As a result, the prior-art tables are susceptible to accidental collapse and, thus, to the risk of personal injury.

In this respect, the unique foldable table of the present invention substantially departs from the conventional concepts and designs of the prior art, and in doing so provides a unique apparatus, which has an automatic button-latching and button-releasing system, an automatic leg-centering system, and an automatic collapse-preventing system, which can:

(a) Automatically latch the release buttons of the table,
(b) Automatically release the release buttons of the table,
(c) Simplify a cumbersome, two-handed operation into an easy, one-handed operation,
(d) Eliminate the needs for stretching the frame of the table while unlocking the table to offer ease of use, durability, and safety,
(e) Automatically center and clamp the extendable-leg assemblies of the table to prevent the extendable-leg assemblies from wobbling,
(f) Automatically cross-interlock the removable tabletop and the frame of the table to prevent the frame from accidentally folding inwards and collapsing and, thus, to prevent the risk of personal injury, and
(g) Secure the removable tabletop of the table onto the frame of the table to prevent the frame from twisting and stretching while in use to strengthen the whole structure of the table while in use for substantially higher degrees of tolerance and durability.

Therefore, there exists a continuing need for a new, improved, easy-to-operate, and safe foldable table. In this regard, the present invention substantially fulfills this need.

OBJECTS AND ADVANTAGES OF THE INVENTION

The present invention substantially departs from the conventional concepts and designs of the prior art. In doing so, the present invention provides a unique foldable table having many unique and significant features, automatic functions, and advantages, which overcome all the disadvantages of the prior art, as follows:

It is an object of the present invention to provide the unique foldable table having an automatic button-latching and button-releasing system, an automatic leg-centering system, and an automatic collapse-preventing system.

It is another object of the present invention to provide the automatic button-latching and button-releasing system for automatically latching the release buttons of the unique foldable table, and for automatically releasing the release buttons of the unique foldable table. The automatic button-latching and button-releasing system can be automatically activated whenever the buttons are pressed, and can be automatically deactivated whenever the table is folded.

It is a further object of the present invention to provide the automatic button-latching and button-releasing system for eliminating the simultaneous needs for using one hand to press the release buttons while using another hand to stretch the frames of the prior-art tables to unlock the prior-art tables at the same time.

It is an even further object of the present invention to provide the automatic button-latching and button-releasing system for simplifying a conventionally cumbersome, two-handed operation of folding the prior-art tables into a uniquely easy, one-handed operation, which requires only one simple push for each of the release buttons.

It is another object of the present invention to provide the automatic button-latching and button-releasing system for eliminating the needs for stretching the frames of the prior-art tables while unlocking the prior-art tables to offer ease of use, safety, and durability, and to eliminate the risk of personal injury.

It is yet another object of the present invention to provide the automatic leg-centering system for automatically centering and clamping the extendable-leg assemblies of the unique foldable table to strengthen the extendable-leg assemblies to prevent them from wobbling while in use.

It is yet another object of the present invention to provide the automatic collapse-preventing system for automatically cross-interlocking the removable tabletop and the frame of the unique foldable table to prevent the frame from accidentally folding inwards and collapsing and, thus, to eliminate the risk of personal injury.

It is still yet another object of the present invention to provide the automatic collapse-preventing system for automatically cross-interlocking the removable tabletop and the frame of the unique foldable table to prevent the frame from twisting and stretching while in use to strengthen the whole structure of the unique foldable table while in use for substantially higher degrees of tolerance and durability.

Other objects and advantages of the present invention will become apparent from a consideration of the accompanying drawings and ensuing description.

SUMMARY OF THE INVENTION

A unique foldable table (having an automatic button-latching and button-releasing system, an automatic leg-centering system, and an automatic collapse-preventing system) comprises a collapse-preventing tabletop assembly, a plurality of extendable-leg assemblies, and a plurality of scissoring-arm assemblies. The scissoring-arm assemblies are attached to the extendable-leg assemblies, respectively. The extendable-leg assemblies are releasably attached to the collapse-preventing tabletop assembly.

The extendable-leg assemblies have an automatic button-latching and button-releasing system and an automatic leg-centering system. The automatic button-latching and button-releasing system has unique spring-loaded latches for automatically latching and automatically releasing the release buttons of the unique foldable table to simplify all conventionally cumbersome, two-handed operations into uniquely easy, one-handed operations. The automatic leg-centering system has unique leg-centering clamps for automatically centering and clamping the extendable-leg assemblies to prevent the extendable-leg assemblies from wobbling.

The collapse-preventing tabletop assembly has an automatic collapse-preventing system. The automatic collapse-preventing system has unique collapse-preventing clamps for automatically cross-interlocking the tabletop and the extendable-leg assemblies to prevent the unique foldable table from folding inwards and, thus, collapsing, to strengthen the whole structure of the unique foldable table, to increase the tolerance, durability, and lifespan of the unique foldable table, and to eliminate the risk of personal injury.

UNIQUE AUTOMATIC FUNCTIONS

Figure 1A:
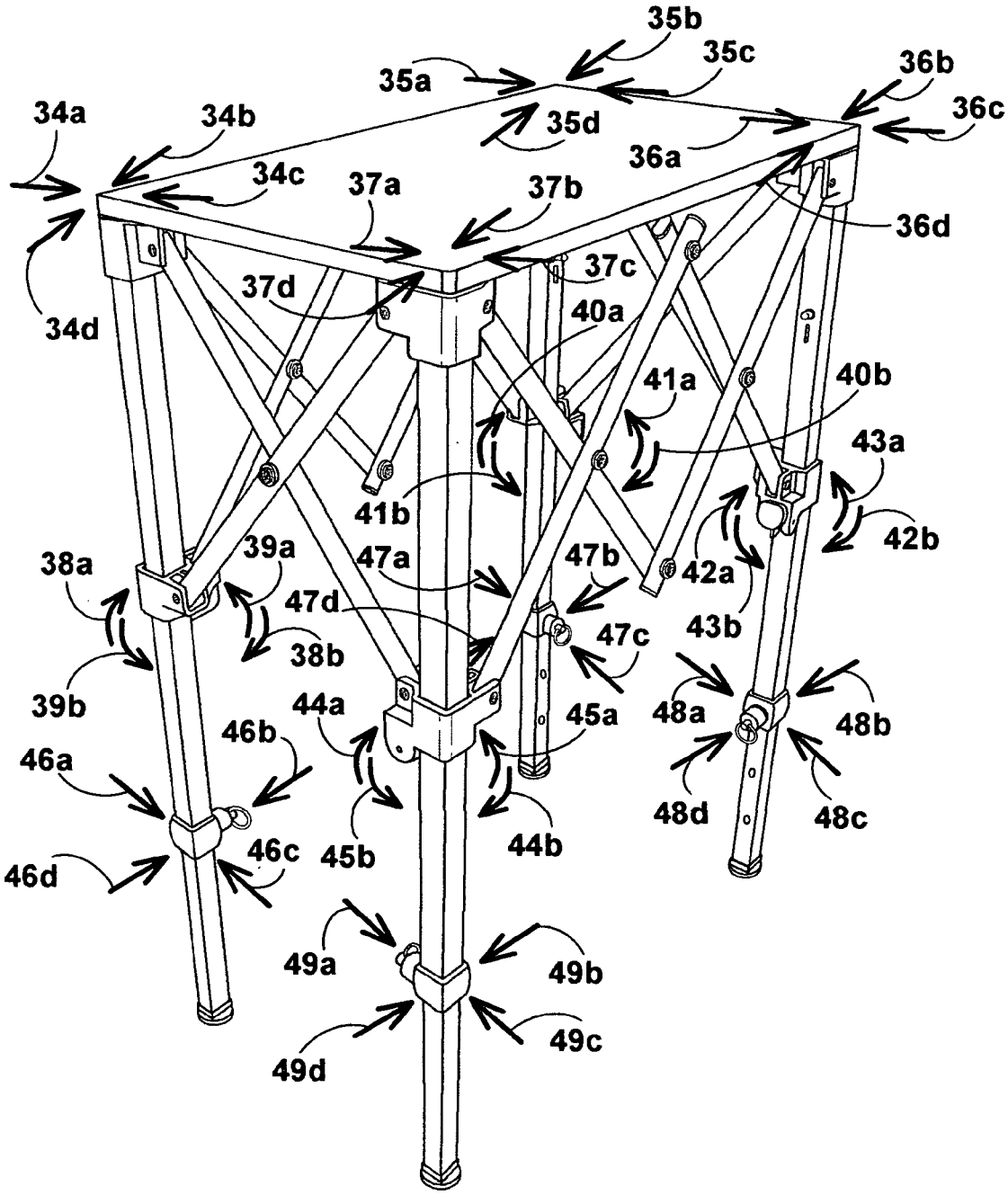
FIG. 1A illustrates all the automatic functions performed by a unique foldable table having an automatic button-latching and button-releasing system, an automatic leg-centering system, and an automatic collapse-preventing system.
Figure 1B:
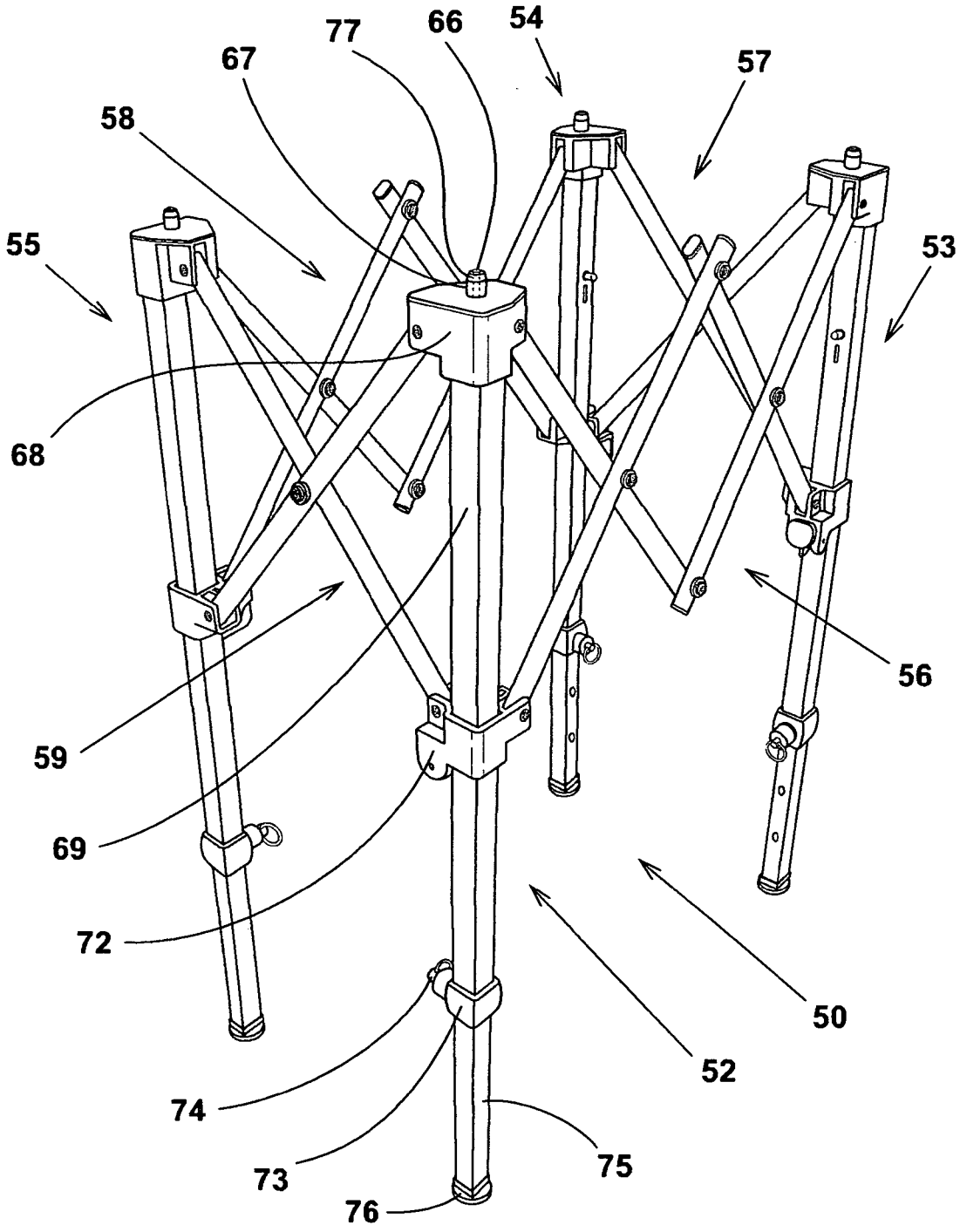
FIG. 1B illustrates a perspective view of the unique foldable table.
Figure 2:
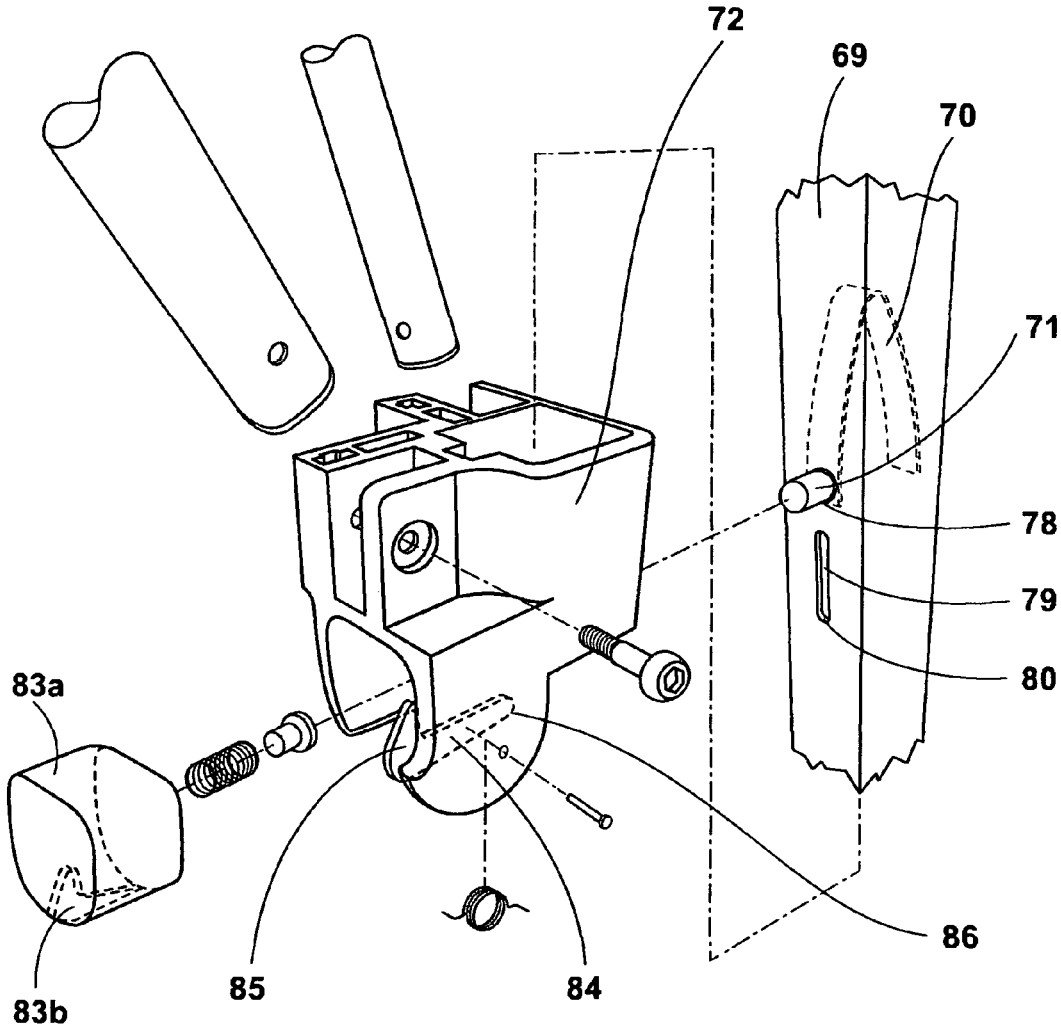
FIG. 2 illustrates an exploded perspective view of the locking sleeve and the automatic latch.
Figure 3:
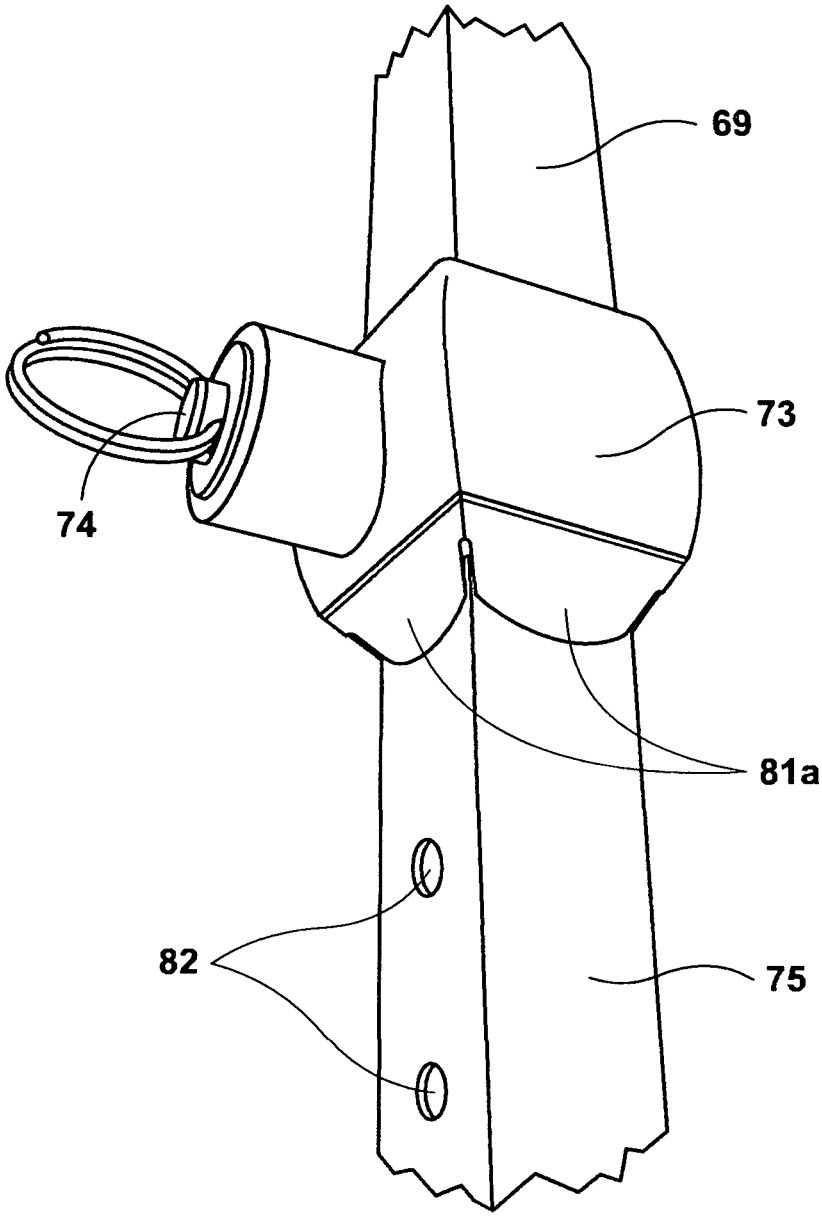
FIG. 3 illustrates a perspective view of an automatic leg-centering clamp.

FIG. 1A illustrates all the automatic functions performed by a unique foldable table having an automatic button-latching and button-releasing system, an automatic leg-centering system, and an automatic collapse-preventing system. The unique foldable table (offering unique advantages of a new, convenient, easy-to-operate, and safe foldable table) performs all the following automatic functions:

1) Four automatic collapse-preventing functions 34*a*, 34*b*, 34*c*, and 34*d* at its first tabletop corner.
2) Four automatic collapse-preventing functions 35*a*, 35*b*, 35*c*, and 35*d* at its second tabletop corner.
3) Four automatic collapse-preventing functions 36*a*, 36*b*, 36*c*, and 36*d* at its third tabletop corner.
4) Four automatic collapse-preventing functions 37*a*, 37*b*, 37*c*, and 37*d* at its fourth tabletop corner.
5) Four automatic button-latching and button-releasing functions 38*a*, 38*b*, 39*a*, and 39*b* at its first locking sleeve.
6) Four automatic button-latching and button-releasing functions 40*a*, 40*b*, 41*a*, and 41*b* at its second locking sleeve.
7) Four automatic button-latching and button-releasing functions 42*a*, 42*b*, 43*a*, and 43*b* at its third locking sleeve.
8) Four automatic button-latching and button-releasing functions 44*a*, 44*b*, 45*a*, and 45*b* at its fourth locking sleeve.
9) Four automatic leg-centering functions 46*a*, 46*b*, 46*c*, and 46*d* at its first leg-centering clamp.
10) Four automatic leg-centering functions 47*a*, 47*b*, 47*c*, and 47*d* at its second leg-centering clamp.
11) Four automatic leg-centering functions 48*a*, 48*b*, 48*c*, and 48*d* at its third leg-centering clamp.
12) Four automatic leg-centering functions 49*a*, 49*b*, 49*c*, and 49*d* at its fourth leg-centering clamp.

PREFERRED EMBODIMENT

Structure and Function

FIGS. 1B, 2, 3, 4A, and 4B illustrate a unique foldable table 50, having an automatic button-latching and button-releasing system, an automatic leg-centering system, and an automatic collapse-preventing system. Unique foldable table 50 comprises a collapse-preventing tabletop 51, a first extendable-leg assembly 52, a second extendable-leg assembly 53, a third extendable-leg assembly 54, a fourth extendable-leg assembly 55, a first scissoring-arm assembly 56, a second scissoring-arm assembly 57, a third scissoring-arm assembly 58, and a fourth scissoring-arm assembly 59.

Collapse-preventing tabletop 51 comprises a tabletop frame 60, a sheet of material 61, and a plurality of collapse-preventing clamps 62*a*, 63*a*, 64*a*, and 65*a* having collapse-preventing lead-in edges 62*b*, 63*b*, 64*b*, and 65*b*, respectively. Sheet of material 61 is welded to tabletop frame 60. Collapse-preventing clamps 62*a*, 63*a*, 64*a*, and 65*a* are welded to the inner surfaces of the four corners of tabletop frame 60, respectively. Collapse-preventing clamps 62*a*, 63*a*, 64*a*, and 65*a* are for clamping on the frame of unique foldable table 50 to automatically cross-interlock the frame of unique foldable table 50 to prevent the frame from folding inwards and, thus, collapsing. Collapse-preventing lead-in edges 62*b*, 63*b*, 64*b*, and 65*b* are for leading collapse-preventing clamps 62*a*, 63*a*, 64*a*, and 65*a* into predetermined clamping positions, respectively.

First extendable-leg assembly 52 comprises a screw 66, a tabletop-locking post 67, a leg cap 68, a leg 69, a locking-peg leaf spring 70, a locking peg 71, a locking sleeve 72, a leg-centering clamp 73, a spring-loaded extendable-leg lock 74, an extendable leg 75, and an extendable-leg foot 76.

Tabletop-locking post 67 has a threaded hole 77 mated to screw 66 for screw 66 to screw into. Tabletop-locking post 67 is integrated into leg cap 68. Screw 66 is screwed into threaded hole 77. Tabletop-locking post 67 is for one of collapse-preventing clamps 62*a*, 63*a*, 64*a*, and 65*a* of tabletop 51 to clamp on to automatically cross-interlock the frame of unique foldable table 50 to prevent the frame from folding inwards and, thus, collapsing.

Leg cap 68 is attached to the top end of leg 69. Leg cap 68 is for connecting one of first, second, third, and fourth extendable-leg assemblies 52, 53, 54, and 55 with two of first, second, third, and fourth scissoring-arm assemblies 56, 57, 58, and 59.

Figure 5:
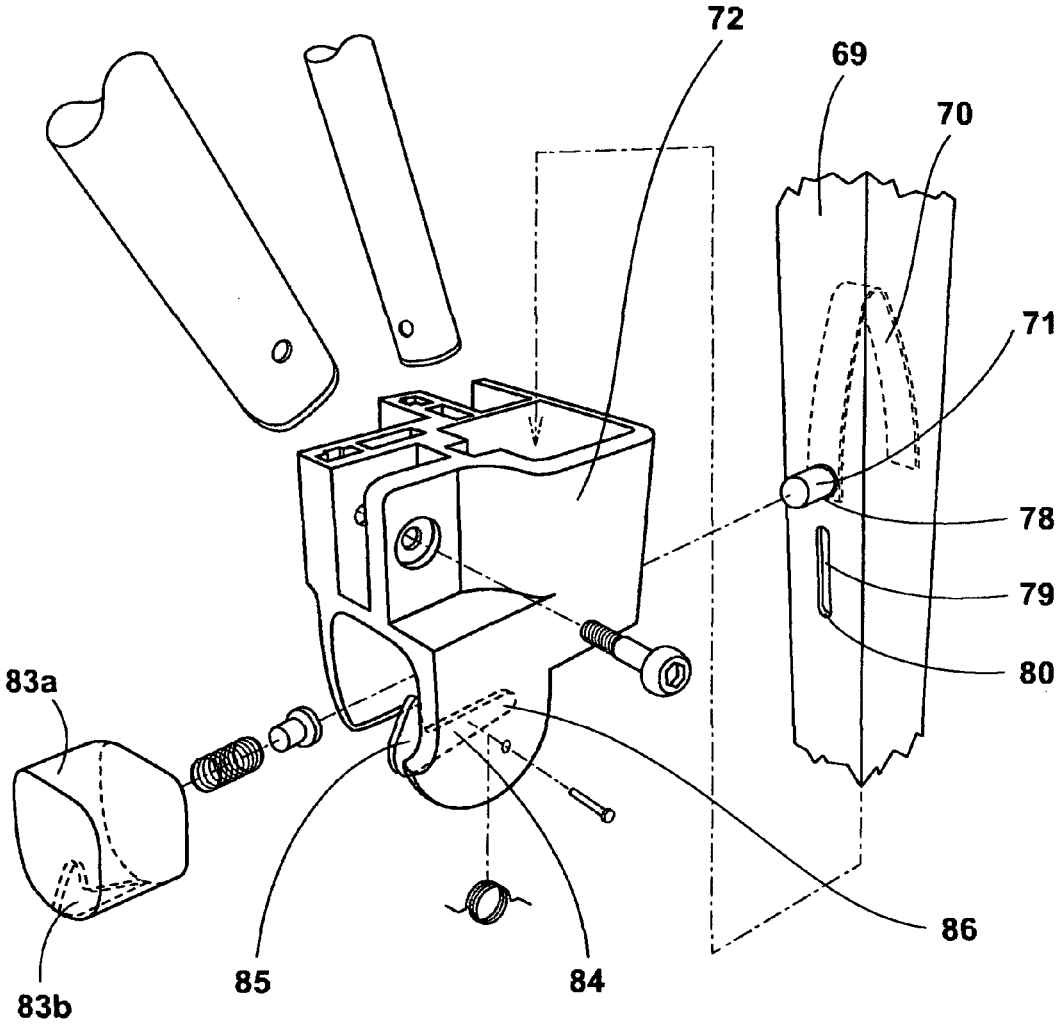
FIG. 5 illustrates an exploded perspective view of the locking sleeve and the automatic latch.

FIG. 5 illustrates leg 69 and locking sleeve 72. Leg 69 has a locking-peg opening 78, a latch-activating opening 79, and a latch-deactivating edge 80. Locking-peg leaf spring 70 is attached to locking peg 71. Locking-peg leaf spring 70 and locking peg 71 are inserted into leg 69 such that the spring force of locking-peg leaf spring 70 pushes locking peg 71 outwards through locking-peg opening 78. Locking peg 71 is for springing into a recess in locking sleeve 72 to secure locking sleeve 72. Locking sleeve 72 is slidably attached to leg 69.

Figure 6:
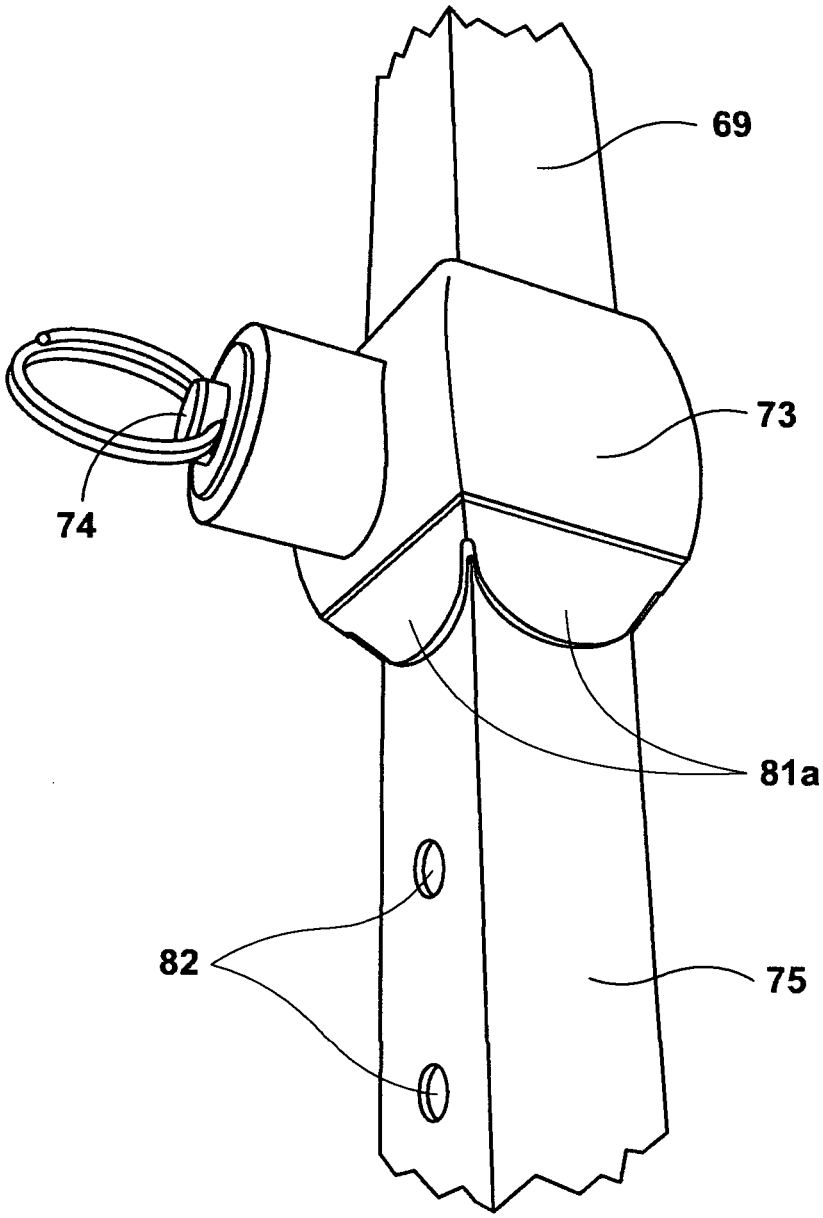
FIG. 6 illustrates a perspective view of an automatic leg-centering clamp.
Figure 7:
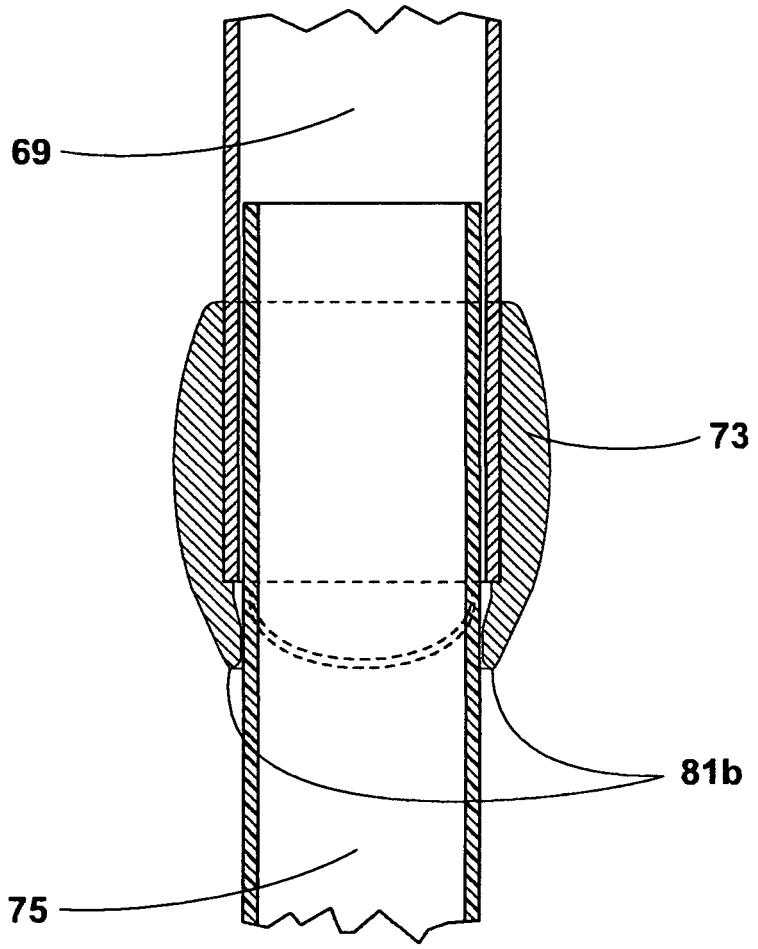
FIG. 7 illustrates a hatching view of the automatic leg-centering clamp.
Figure 8A:
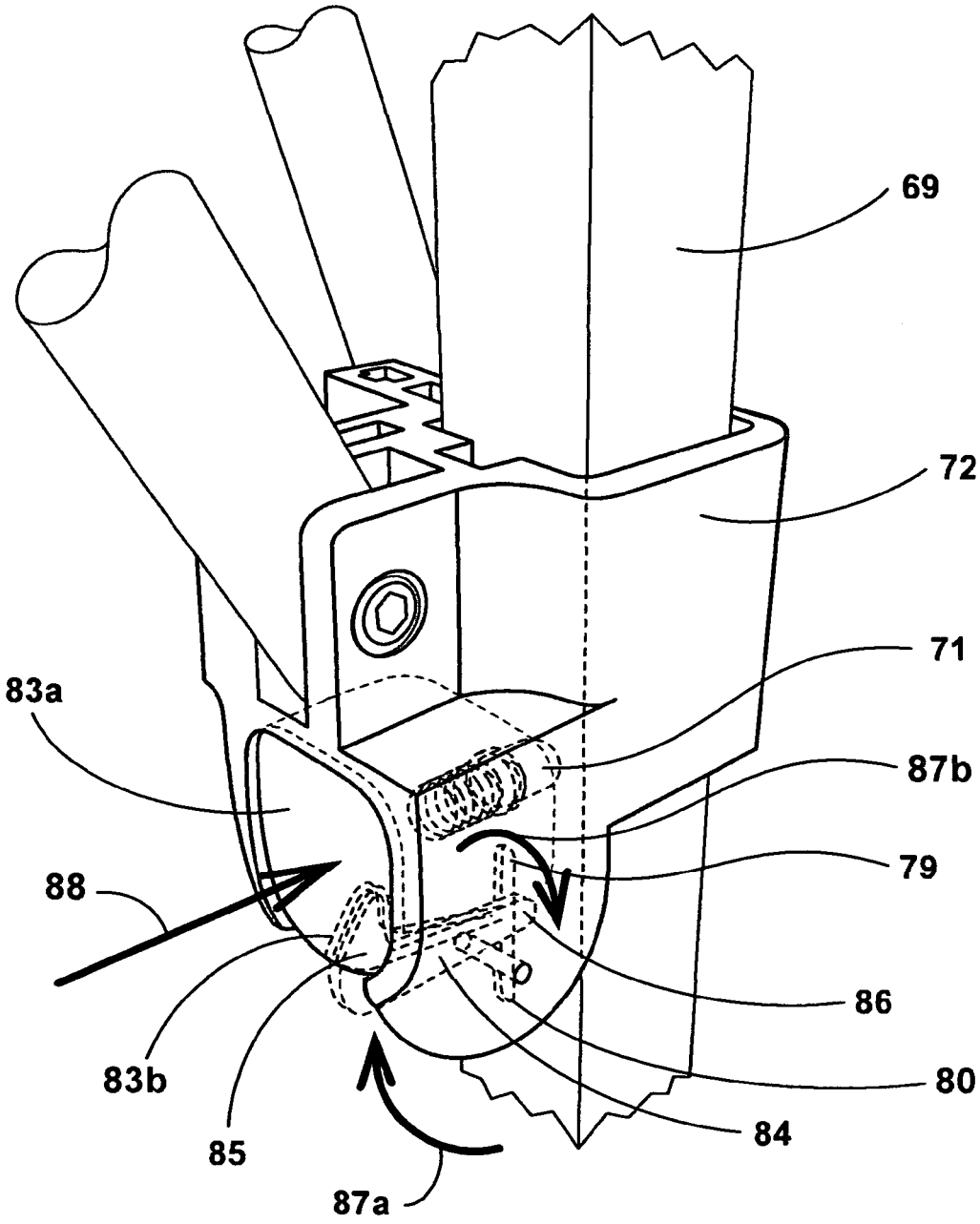
FIG. 8A illustrates a perspective view of a locking sleeve and an automatic latch in a button-latching position.
Figure 8B:
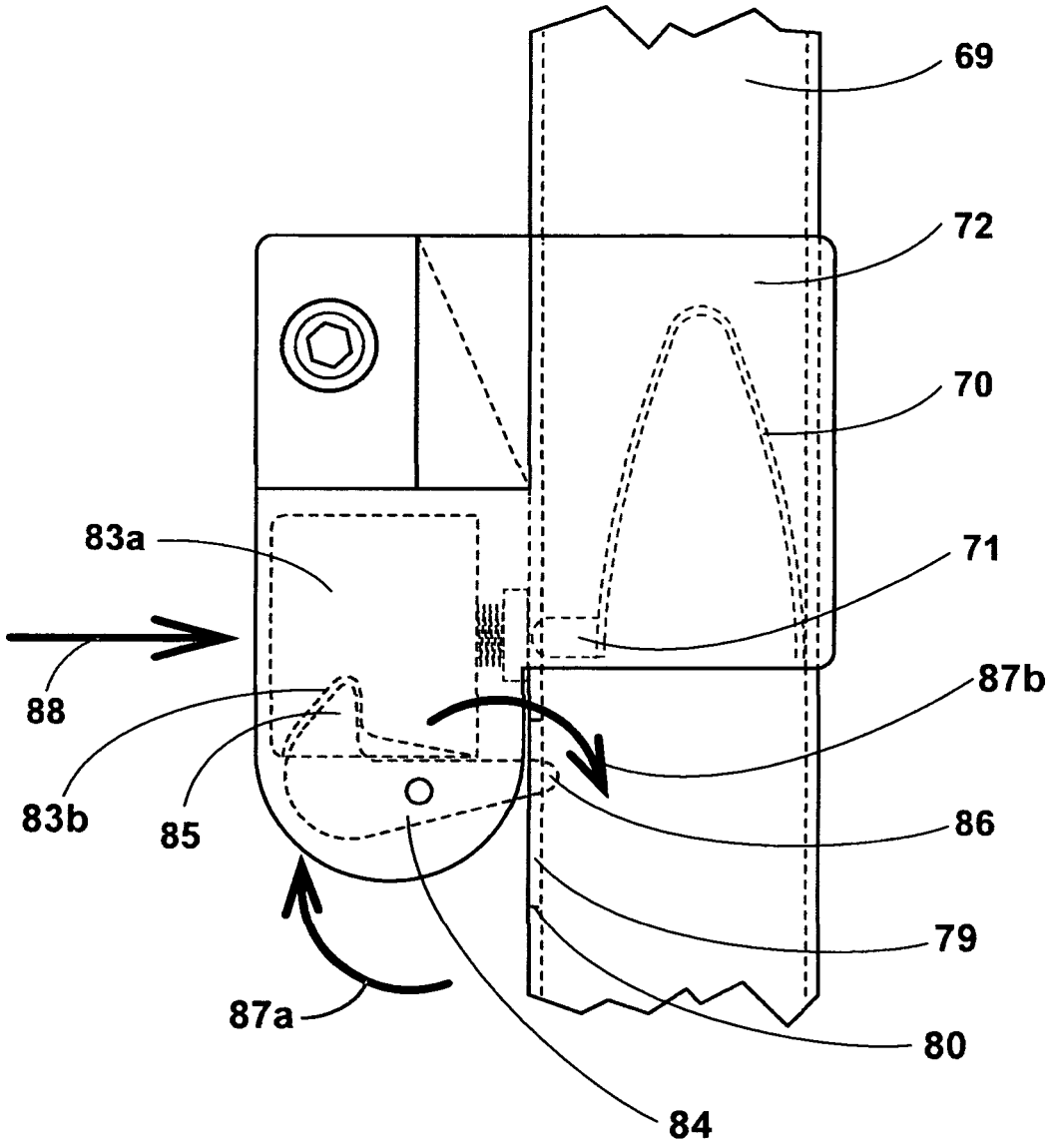
FIG. 8B illustrates a side view of the locking sleeve and the automatic latch in a button-latching position.

FIGS. 6 and 7 illustrate perspective and hatching views of leg-centering clamp 73. Leg-centering clamp 73 has a plurality of predetermined clamping jaws 81*a* and a plurality of clamping lead-in edges 81*b*. Clamping jaws 81*a* are disposed at predetermined locations thereon, and capable of automatically centering and clamping extendable leg 75 to strengthen and prevent extendable leg 75 from wobbling. Leg-centering clamp 73 is snapped on the bottom end of leg 69. Leg-centering clamp 73 is for automatically centering and clamping extendable leg 75 to strengthen and prevent extendable leg 75 from wobbling. Spring-loaded extendable-leg lock 74 is integrated into leg-centering clamp 73. Spring-loaded extendable-leg lock 74 is for locking extendable leg 75 in place.

Extendable leg 75 has a plurality of extendable-leg-locking openings 82. Extendable leg 75 is inserted into leg 69. Extendable leg 75 is able to extend or retract to adjust the height of unique foldable table 50. Each of extendable-leg-locking openings 82 is disposed at a predetermined location on extendable leg 75. Each of extendable-leg-locking openings 82 is for extendable-leg lock 74 to be inserted into to lock extendable leg 75 in place. Extendable-leg foot 76 is screwed into the bottom end of extendable leg 75. Extendable-leg foot 76 is for stabilizing unique foldable table 50 when set on a surface.

Figure 9A:
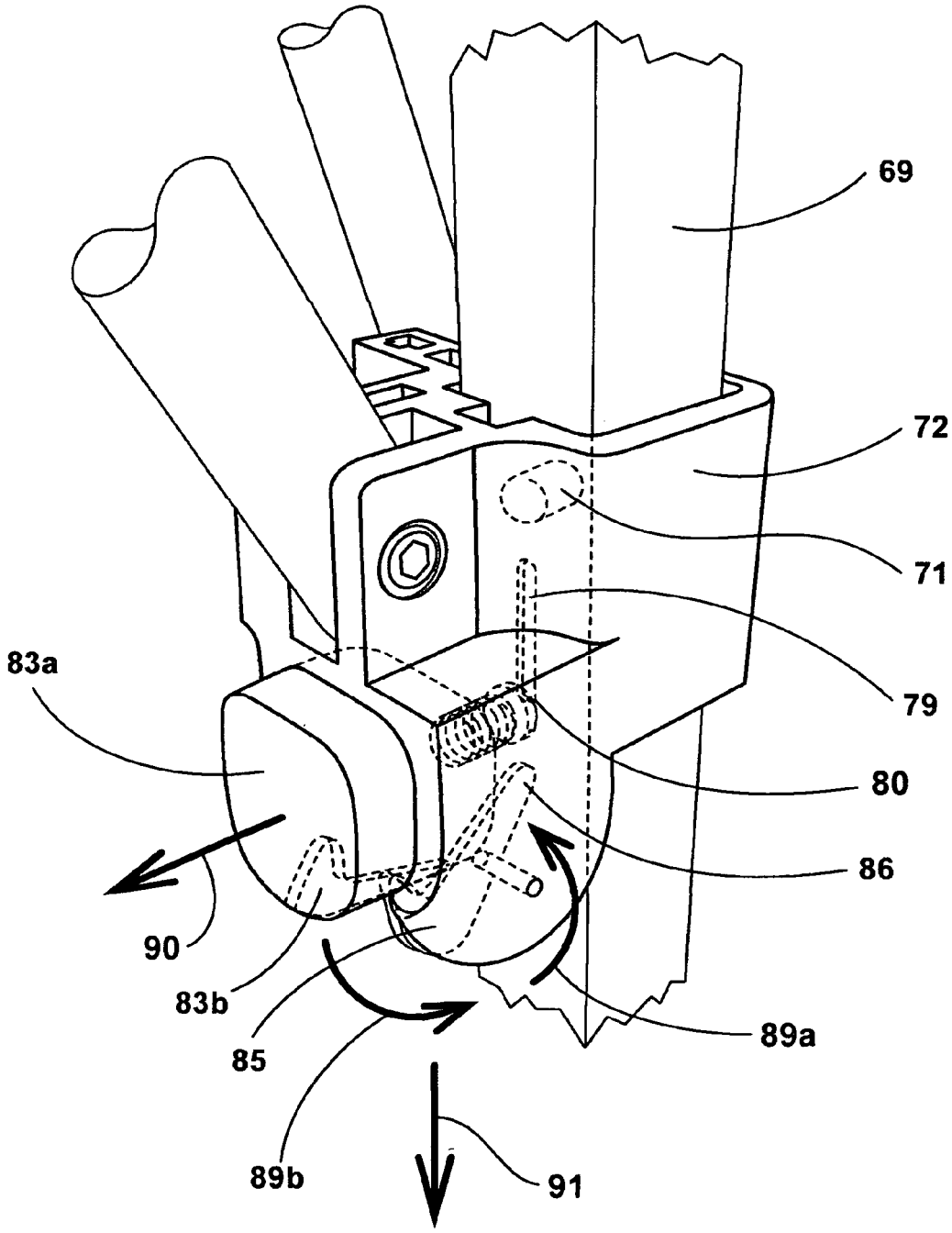
FIG. 9A illustrates a perspective view of the locking sleeve and the automatic latch in a button-releasing position.
Figure 9B:
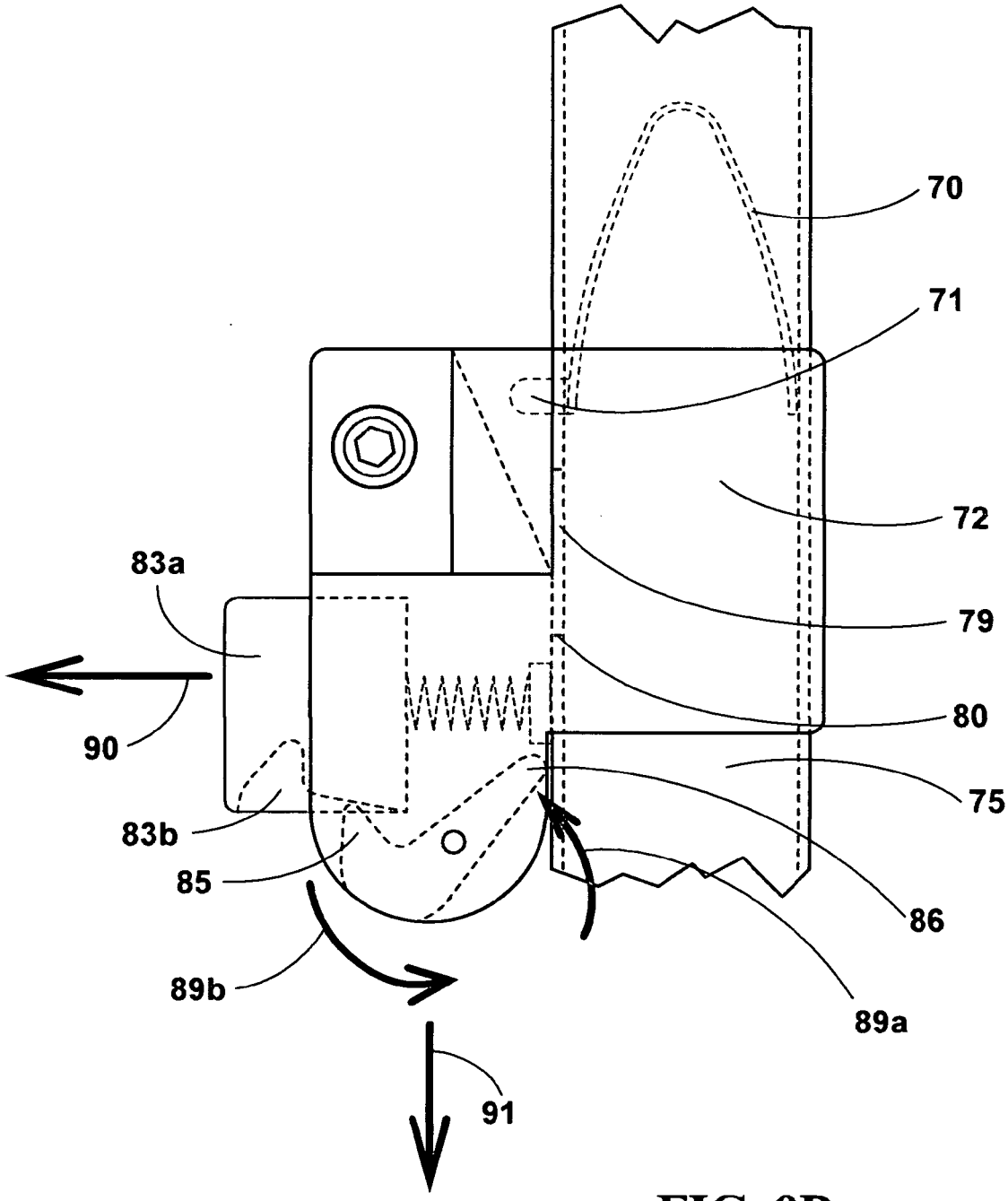
FIG. 9B illustrates a side view of the locking sleeve and the automatic latch in a button-releasing position.
Figure 10:
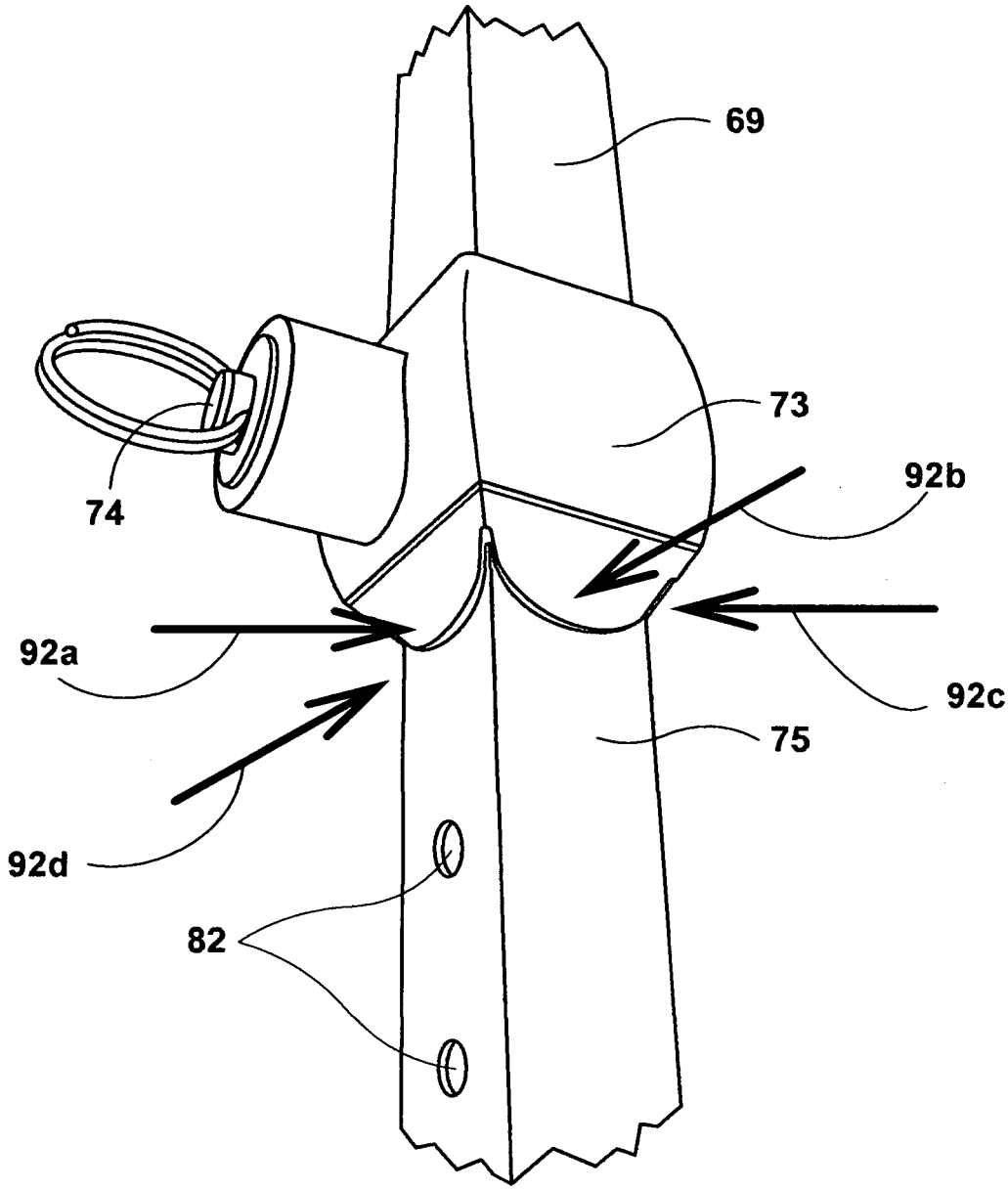
FIG. 10 illustrates a perspective view of a spring-loaded extendable-leg lock.

FIGS. 8A, 8B, 9A, and 9B illustrate locking sleeve 72. Locking sleeve 72 has a spring-loaded button 83*a*, a button groove 83*b*, and a spring-loaded J-shaped latch 84. Spring-loaded J-shaped latch 84 is pivotably attached to locking sleeve 72. Spring-loaded J-shaped latch 84 has a latch head 85 and a latch tail 86:

a) Latch head 85 is for automatically latching onto spring-loaded button 83*a* in the directions of arrows 87*a* and 87*b* when spring-loaded button 83*a* is pressed in the direction of arrow 88, to lock spring-loaded button 83*a* in place (FIGS. 8A and 8B).
b) Latch tail 86 is for automatically releasing spring-loaded button 83*a* in the directions of arrows 89*a* and 89*b* (when locking sleeve 72 slides down in the direction of arrow 91, causing latch-deactivating edge 80 to automatically lift up and rotate latch tail 86 in the directions of arrows 89*a* and 89*b*) to return spring-loaded button 83*a* back to its original position in the direction of arrow 90 when locking sleeve 72 is pushed downward in the direction of arrow 91 (FIGS. 9A and 9B).

Locking sleeve 72 is for connecting and releasably locking together one of first, second, third, and fourth extendable-leg assemblies 52, 53, 54, and 55 and two of first, second, third, and fourth scissoring-arm assemblies 56, 57, 58, and 59.

First, second, third, and fourth extendable-leg assemblies 52, 53, 54, and 55 each are identical to and function like the others.

Each of first, second, third, and fourth scissoring-arm assemblies 56, 57, 58, and 59 comprises a plurality of scissoring arms, screws, and nuts. By using the screws and nuts, the scissoring arms are connected to one another and to first, second, third, and fourth extendable-leg assemblies 52, 53, 54, and 55, respectively, as illustrated in FIG. 1, such that first, second, third, and fourth scissoring-arm assemblies 56, 57, 58, and 59 can contract and expand to allow first, second, third, and fourth extendable-leg assemblies 52, 53, 54, and 55 to fold and unfold, respectively.

First and third scissoring-arm assemblies 56 and 58 each are identical to and function like the other. Second and fourth scissoring-arm assemblies 57 and 59 each are identical to and function like the other.

Material

The components of unique foldable table 50, each independently from the others, can be made of or made from rigid material(s), non-rigid material(s), flexible material(s), non-flexible material(s), resilient materials(s), non-resilient material(s), elastic materials(s), non-elastic material(s), or a combination of at least two of the above. For example, any of the components of unique foldable table 50 can be made of or made from plasticized material(s), metallic material(s), or a combination of the above. For another example, any of the components of unique foldable table 50 can be made of plastic, ABC, PVC, fiber class, iron, copper, zinc, bronze, tin, alloy, aluminum, stainless steel, the like, the equivalent, or a combination of at least two of the above. For another example, clamping jaws 81*a* of leg-centering clamp 73 can be made of or made from semi-rigid or semi-resilient material (s), such that clamping jaws 81*a* can clamp and center extendable leg 75, within leg 69. For another example, leg-centering clamp 73 can be made of or made from plastic, plasticized material(s), the like, or the equivalent.

Operation

The unique foldable table has the automatic button-latching and button-releasing system, the automatic leg-centering system, and the automatic collapse-preventing system. Referring to FIGS. 8A, 8B, 9A, 9B, and 10:

A) To Unfold Unique Foldable Table 50 from a Folded Position:

Pulling outwards first, second, third, and fourth extendable-leg assemblies 52, 53, 54, and 55;

Sliding upwards locking sleeve 72 and other identical locking sleeves of first, second, third, and fourth extendable-leg assemblies 52, 53, 54, and 55, respectively, until locking peg 71 and other identical locking pegs of first, second, third, and fourth extendable-leg assemblies 52, 53, 54, and 55 snap-lock locking sleeve 72 and other identical locking sleeves of first, second, third, and fourth extendable-leg assemblies 52, 53, 54, and 55, respectively, to lock first, second, third, and fourth extendable-leg assemblies 52, 53, 54, and 55 and first, second, third, and fourth scissoring-arm assemblies 56, 57, 58, and 59 in place; and Installing collapse-preventing tabletop 51 on leg cap 68 and other identical leg caps of first, second, third, and fourth extendable-leg assemblies 52, 53, 54, and 55 such that collapse-preventing lead-in edges 62*b*, 63*b*, 64*b*, and 65*b* lead collapse-preventing clamps 62*a*, 63*a*, 64*a*, and 65*a* into predetermined clamping positions, and such that collapse-preventing clamps 62*a*, 63*a*, 64*a*, and 65*a* clamp on tabletop-locking post 67 and other identical tabletop-locking posts of first, second, third, and fourth extendable-leg assemblies 52, 53, 54, and 55, respectively, to automatically cross-interlock first, second, third, and fourth extendable-leg assemblies 52, 53, 54, and 55 and first, second, third, and fourth scissoring-arm assemblies 56, 57, 58, and 59.

As a Result:

1) The automatic collapse-preventing system automatically cross-interlocks first, second, third, and fourth extendable-leg assemblies 52, 53, 54 and 55 and first, second, third, and fourth scissoring arm assemblies 56, 57, 58, and 59 to prevent them from accidentally folding inwards in the directions of arrows 62*c*, 63*c*, 64*c*, and 65*c* (FIG. 4A) and, thus, to prevent them from collapsing while in use; and
2) The automatic leg-centering system automatically centers and clamps extendable leg 75 and other identical extendable legs of first, second, third, and fourth extendable-leg assemblies 52, 53, 54, and 55 in the directions of arrows 92*a*, 92*b*, 92*c*, and 92*d* (FIG. 10) to prevent extendable leg 75 and the other identical extendable legs from wobbling.

B) To Fold Up Unique Foldable Table 50 from an Unfolded Position:

Lifting collapse-preventing tabletop 51 off of leg cap 68 and the other identical leg caps.

Pressing spring-loaded button 83*a* (FIGS. 8A and 8B), in the direction of arrow 88, and other identical spring-loaded buttons of first, second, third, and fourth extendable-leg assemblies 52, 53, 54, and 55 to press locking peg 71 and other identical locking pegs of first, second, third, and fourth extendable-leg assemblies 52, 53, 54, and 55 out of locking sleeve 72 and the other identical locking sleeves, respectively, until latch head 85 and other identical latch heads of first, second, third, and fourth extendable-leg assemblies 52, 53, 54, and 55 automatically snap into button groove 83*b* and other identical button grooves of first, second, third, and fourth extendable-leg assemblies 52, 53, 54, and 55 and latch on spring-loaded button 83*a* and the other identical spring-loaded buttons (FIGS. 8A and 8B), in the directions of arrows 87*a* and 87*b*, respectively, and until latch tail 86 and other identical latch tails of first, second, third, and fourth extendable-leg assemblies 52, 53, 54, and 55 automatically rotate into latch-activating opening 79 and other identical latch-activating openings of first, second, third, and fourth extendable-leg assemblies 52, 53, 54, and 55; and Folding inwards first, second, third, and fourth extendable-leg assemblies 52, 53, 54 and 55 to slide downwards latch tail 86 and the other identical latch tails (FIGS. 9A and 9B), in the direction of arrow 91, until latch-deactivating edge 80 and other identical latch-deactivating edges of first, second, third, and fourth extendable-leg assemblies 52, 53, 54, and 55 automatically lift up and rotate latch tail 86 and the other identical latch tails (FIGS. 9A and 9B), in the direction of arrow 89*a*, to automatically rotate latch head 85 and the other identical latch heads downwards (FIGS. 9A and 9B), in the direction of arrow 89*b*, and until latch head 85 and the other identical latch heads automatically release spring-loaded button 83*a*, in the direction of arrow 90, and the other identical spring-loaded buttons, respectively, and spring-loaded button 83*a* and the other identical spring-loaded buttons return back to their original positions (FIGS. 9A and 9B), which automatically rotate latch tail 86 and the other identical latch tails upwards and away further from latch-deactivating edge 80 and the other identical latch-deactivating edges, respectively (for example, to prevent latch tail 86 and the other identical latch tails from scratching other components of unique foldable table 50).

As a Result:

1) The automatic button-latching and button-releasing system automatically latches on, automatically releases, and automatically resets spring-loaded button 83*a* and the other identical spring-loaded buttons to turn a cumbersome, two-handed operation into an easy, one-handed operation; and 2) The automatic button-latching and button-releasing system eliminates the simultaneous needs for using one hand to press spring-loaded button 83*a* and the other identical spring-loaded buttons while using another hand to stretch the table frame, at the same time, to unlock the table frame.

C) To Adjust the Height of Unique Foldable Table 50:

Pulling on extendable-leg lock 74 (FIG. 10) and other identical extendable-leg locks of first, second, third, and fourth extendable-leg assemblies 52, 53, 54, and 55 until extendable leg 75 and the other identical extendable legs are unlocked, respectively;

Pulling extendable leg 75 and the other identical extendable legs downwards to raise unique foldable table 50 to a desired height; and Pressing extendable-leg lock 74 and the other identical extendable-leg locks back into one of extendable-leg-locking openings 82 and ones of other identical extendable-leg-locking openings of first, second, third, and fourth extendable-leg assemblies 52, 53, 54, and 55 until extendable leg 75 and the other identical extendable legs are locked, respectively.

As a Result:

1) The automatic leg-centering system automatically centers and clamps extendable leg 75 and the other identical extendable legs to prevent extendable leg 75 and the other identical extendable legs from wobbling while in use; and 2) The automatic leg-centering system automatically strengthens first, second, third, and fourth extendable-leg assemblies 52, 53, 54, and 55, and thus automatically strengthens the whole structure of unique foldable table 50 while in use for substantially higher degrees of tolerance and durability.

Figure 4A:
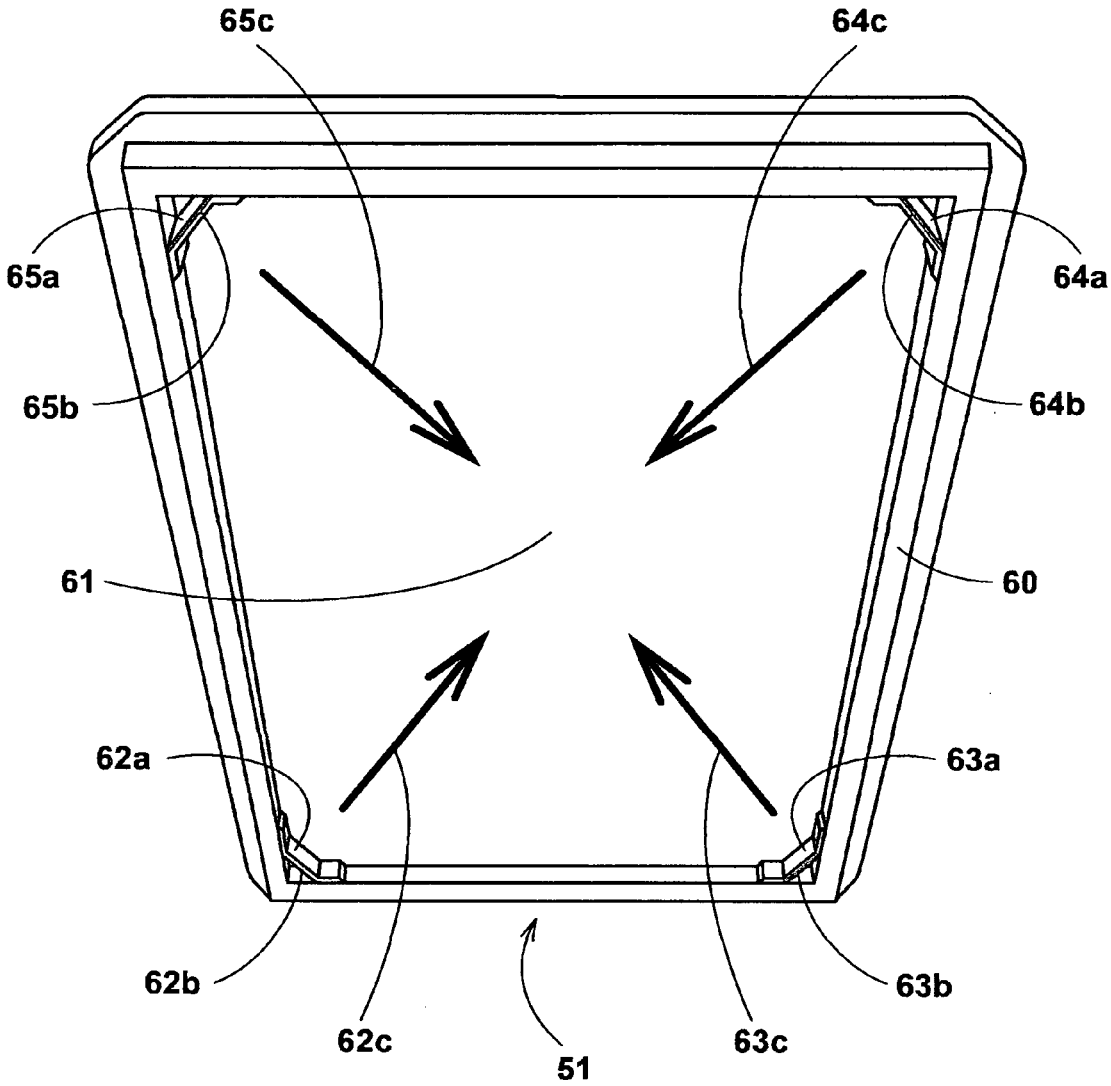
FIG. 4A illustrates a perspective view of an automatic collapse-preventing system having collapse-preventing clamps.
Figure 4B:
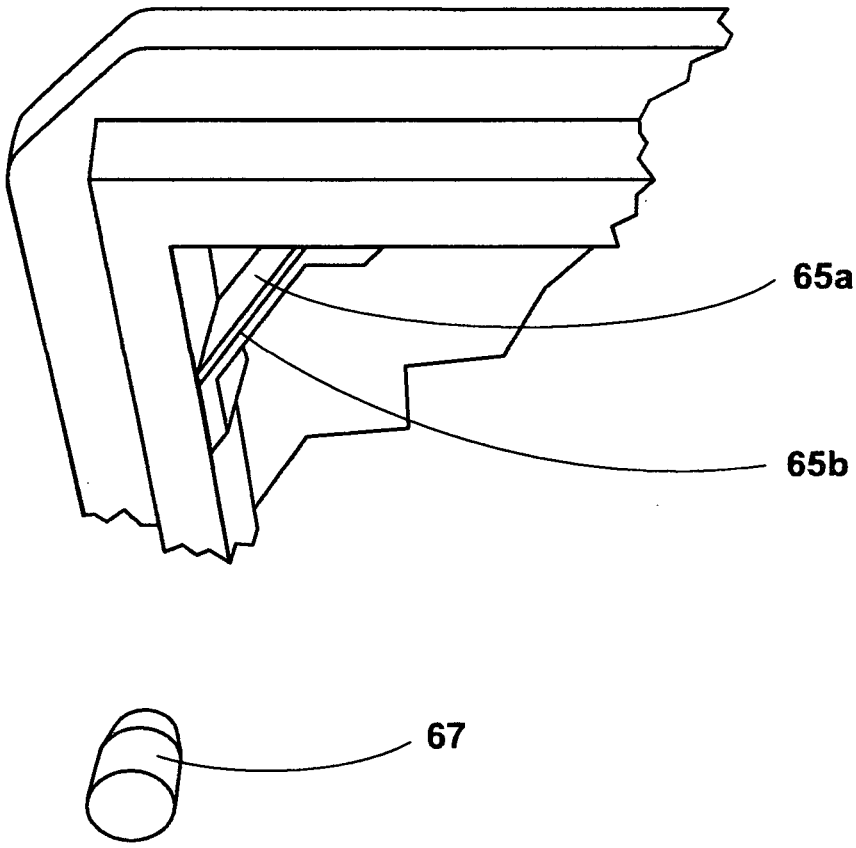
FIG. 4B illustrates a perspective view of an automatic collapse-preventing clamp and a tabletop-locking post.
Figure 11:
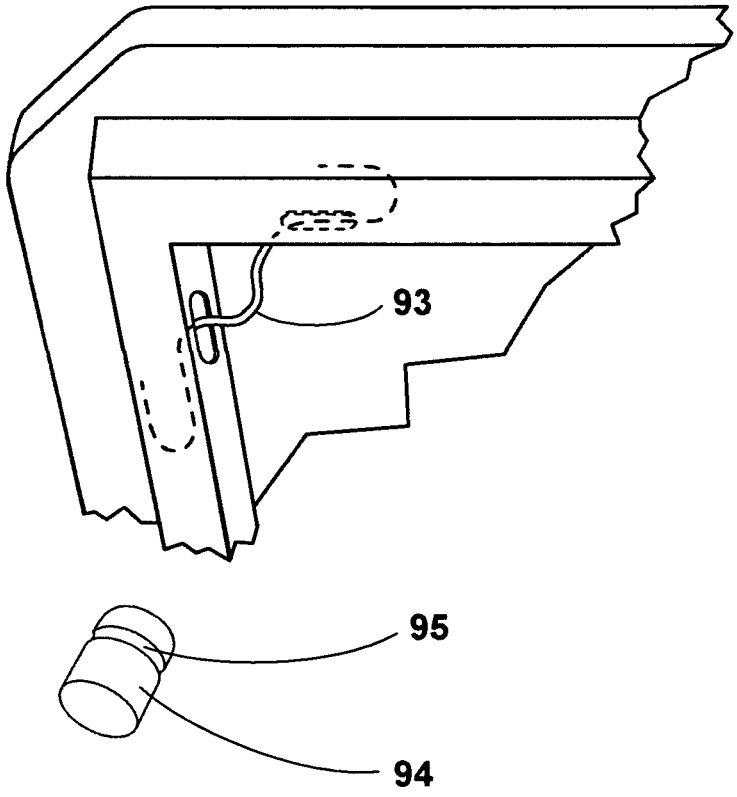
FIG. 11 illustrates an equivalent of collapse-preventing clamps.

FIG. 11 illustrates a spring clamp 93 and a tabletop-locking post 94. Spring clamp 93 is equivalent to, functions similarly to, and can replace collapse-preventing clamp 65*a* in the first example above (FIG. 4B). The two opposite ends of spring clamp 93 are snapped into the two opposite openings at the corner of tabletop frame 60 to be attached thereto. Tabletop-locking post 94 is equivalent to, functions similarly to, and can replace tabletop-locking post 67 in the first example above (FIG. 4B). Tabletop-locking post 94 has a circular groove 95 for spring clamp 93 to snap therein to be releasably secured therein when installing collapse-preventing tabletop 51 on first, second, third, and fourth extendable-leg assemblies 52, 53, 54, and 55.

Majors Advantages

The present invention substantially departs from the conventional concepts and designs of the prior art. In doing so, the present invention provides a unique foldable table having many unique and significant features, automatic functions, and advantages, which overcome all the disadvantages of the prior art, as follows:

It is an object of the present invention to provide the unique foldable table having an automatic button-latching and button-releasing system, an automatic leg-centering system, and an automatic collapse-preventing system.

It is another object of the present invention to provide the automatic button-latching and button-releasing system for automatically latching the release buttons of the unique foldable table, and for automatically releasing the release buttons of the unique foldable table. The automatic button-latching and button-releasing system can be automatically activated whenever the buttons are pressed, and can be automatically deactivated whenever the table is folded.

It is a further object of the present invention to provide the automatic button-latching and button-releasing system for eliminating the simultaneous needs for using one hand to press the release buttons while using another hand to stretch the frames of the prior-art tables to unlock the prior-art tables at the same time.

It is an even further object of the present invention to provide the automatic button-latching and button-releasing system for simplifying a conventionally cumbersome, two-handed operation of folding the prior-art tables into a uniquely easy, one-handed operation, which requires only one simple push for each of the release buttons.

It is another object of the present invention to provide the automatic button-latching and button-releasing system for eliminating the needs for stretching the frames of the prior-art tables while unlocking the prior-art tables to offer ease of use, safety, and durability, and to eliminate the risk of personal injury.

It is yet another object of the present invention to provide the automatic leg-centering system for automatically centering and clamping the extendable-leg assemblies of the unique foldable table to strengthen the extendable-leg assemblies to prevent them from wobbling while in use.

It is yet another object of the present invention to provide the automatic collapse-preventing system for automatically cross-interlocking the removable tabletop and the frame of the unique foldable table to prevent the frame from accidentally folding inwards and collapsing and, thus, to eliminate the risk of personal injury.

It is still yet another object of the present invention to provide the automatic collapse-preventing system for automatically cross-interlocking the removable tabletop and the frame of the unique foldable table to prevent the frame from twisting and stretching while in use to strengthen the whole structure of the unique foldable table while in use for substantially higher degrees of tolerance and durability.

UNIQUE AUTOMATIC FUNCTION

Figure 12:
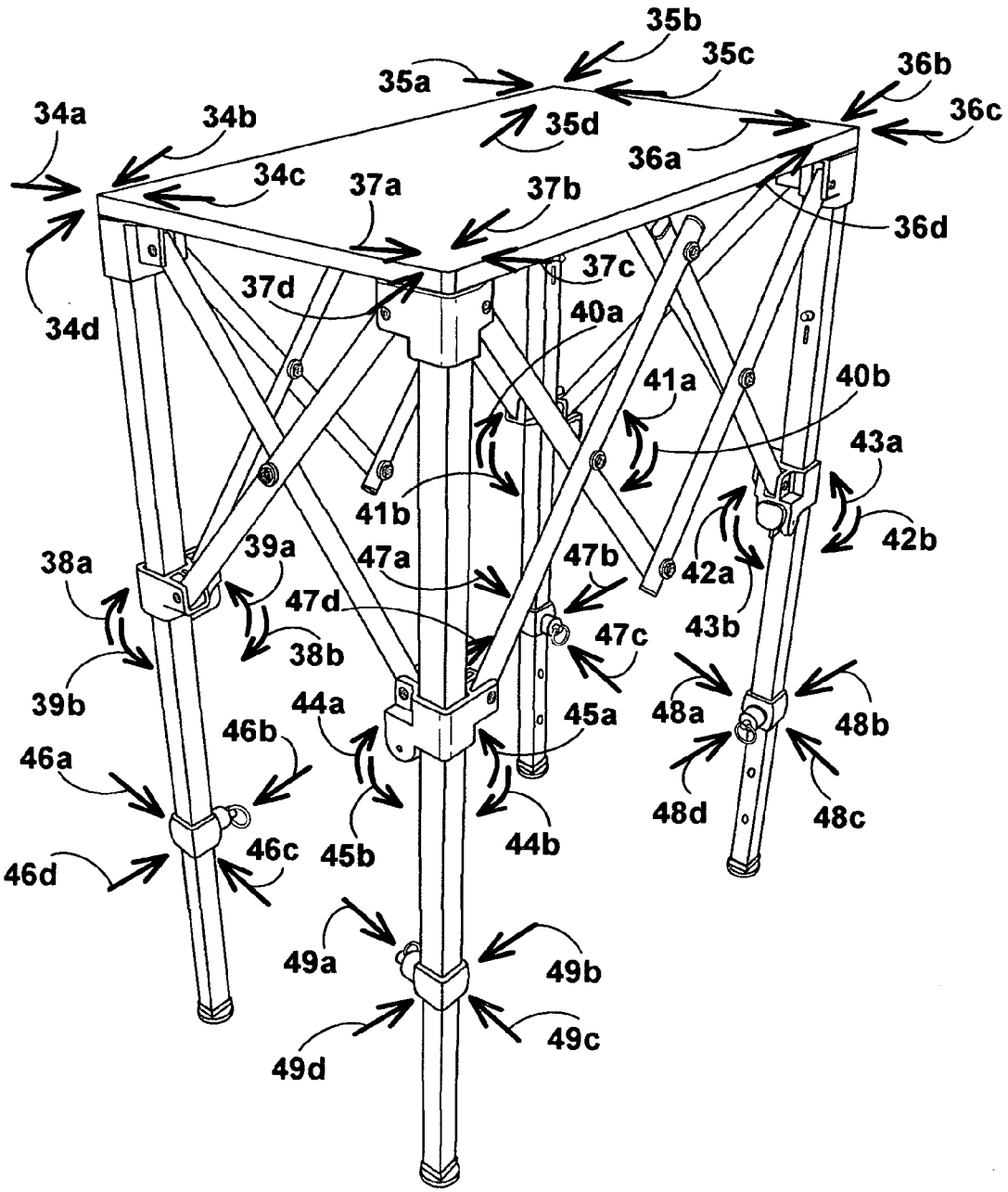
FIG. 12 illustrates all the automatic functions performed by the unique foldable table.

FIG. 12 is a duplicate of FIG. 1A, illustrating all the automatic functions performed by the unique foldable table having an automatic button-latching and button-releasing system, an automatic leg-centering system, and an automatic collapse-preventing system. The unique foldable table (offering unique advantages of a new, convenient, easy-to-operate, and safe foldable table) performs all the following automatic functions:

1) Four automatic collapse-preventing functions 34*a*, 34*b*, 34*c*, and 34*d* at its first tabletop corner.
2) Four automatic collapse-preventing functions 35*a*, 35*b*, 35*c*, and 35*d* at its second tabletop corner.
3) Four automatic collapse-preventing functions 36*a*, 36*b*, 36*c*, and 36*d* at its third tabletop corner.
4) Four automatic collapse-preventing functions 37*a*, 37*b*, 37*c*, and 37*d* at its fourth tabletop corner.
5) Four automatic button-latching and button-releasing functions 38*a*, 38*b*, 39*a*, and 39*b* at its first locking sleeve.
6) Four automatic button-latching and button-releasing functions 40*a*, 40*b*, 41*a*, and 41*b* at its second locking sleeve.
7) Four automatic button-latching and button-releasing functions 42*a*, 42*b*, 43*a*, and 43*b* at its third locking sleeve.
8) Four automatic button-latching and button-releasing functions 44*a*, 44*b*, 45*a*, and 45*b* at its fourth locking sleeve.
9) Four automatic leg-centering functions 46*a*, 46*b*, 46*c*, and 46*d* at its first leg-centering clamp.

10) Four automatic leg-centering functions 47*a*, 47*b*, 47*c*, and 47*d* at its second leg-centering clamp.

11) Four automatic leg-centering functions 48*a*, 48*b*, 48*c*, and 48*d* at its third leg-centering clamp.

12) Four automatic leg-centering functions 49*a*, 49*b*, 49*c*, and 49*d* at its fourth leg-centering clamp.

CONCLUSION

Figure 13:
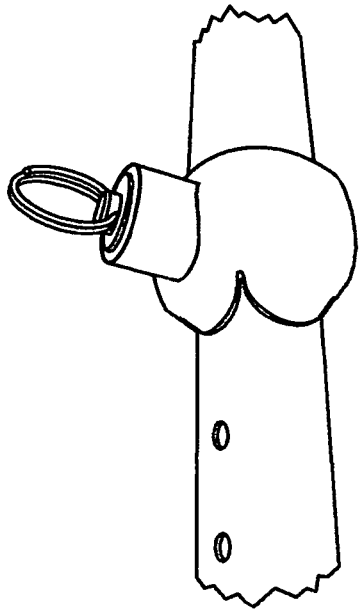
FIG. 13 illustrates equivalents of a leg, an automatic leg-centering clamp, and an extendable leg.
Figure 14:
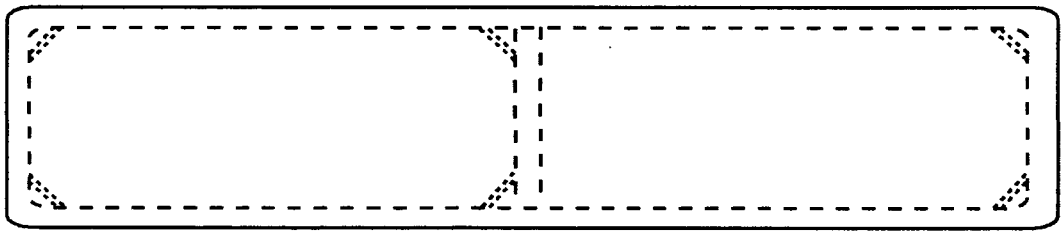
FIG. 14 illustrates an equivalent of a collapse-preventing tabletop.

Any component and the cross-section of any component of the unique foldable table can have any shape and size. The unique foldable table can have any number of any of its components, and can be used to support any type of weight, such as human or object. For example, FIG. 13 illustrates a round leg, round leg-centering clamp, and round extendable leg, which are equivalents of leg 69, leg-centering clamp 73, and extendable leg 75. For another example, the unique foldable table can have more than four extendable-leg assemblies as illustrated in FIG. 14.

What is claimed is:

1. A foldable table comprising:

a collapse-preventing top, said collapse-preventing top comprising a top frame, a sheet of material, and a plurality of collapse-preventing clamps, said sheet of material attached to said top frame, said top frame having a plurality of corners each of which has an inner surface, said collapse-preventing clamps attached to the inner surfaces of the four corners of said top frame by top-clamp-attaching means, respectively;

a plurality of extendable-leg assemblies, each of said extendable-leg assemblies comprising a top-locking post, a leg cap, a leg, a locking-peg leaf spring, a locking peg, a locking sleeve, a leg-centering clamp, a spring-loaded extendable-leg lock, an extendable leg, and an extendable-leg foot, said top-locking post integrated into said leg cap, said top-locking post for one of said collapse-preventing clamps of said collapse-preventing top to clamp on to interlock said extendable-leg assemblies, said leg cap attached to an end of said leg, said leg having a locking-peg opening, said locking-peg leaf spring integrated into said locking peg, said locking-peg leaf spring and said locking peg inserted into said leg such that the spring force of said locking-peg leaf spring pushes said locking peg through said locking-peg opening, said locking sleeve slid on said leg such that said locking sleeve is slidably attached to said leg, said locking sleeve having a recess, said recess for said locking peg to be pressed into to secure said locking sleeve when said recess slides over said locking peg, said leg-centering clamp having a plurality of predetermined clamping jaws, said leg-centering clamp having a ring-like edge and an invisible longitudinal central axis, said clamping jaws molded to and along said ring-like edge of said leg-centering clamp such that said clamping jaws surround and lean inward toward said invisible central axis of said leg-centering clamp at a predetermined angle creating a force for said clamping jaws to center said extendable leg, said leg-centering clamp attached to another end of said leg by centering-clamp-attaching means, said spring-loaded extendable-leg lock integrated into said leg-centering clamp, said extendable leg inserted into said leg-centering clamp and said leg, said extendable leg capable of extending and retracting to adjust the height of said foldable table, said extendable leg having a plurality of extendable-leg-locking openings, each of said extendable-leg-locking openings disposed at a predetermined location on said extendable leg, each of said extendable-leg-locking openings for said extendable-leg lock to be pressed into to lock said extendable leg at a predetermined location inside said leg, said extendable-leg foot attached to an end of said extendable leg by foot-attaching means, said extendable-leg foot for stabilizing said foldable table when set on a surface; and a plurality of scissoring-arm assemblies, each of said scissoring-arm assemblies comprising a plurality of scissoring arms, a plurality of screws, and a plurality of nuts, said scissoring arms pivotally connected to one another in a scissoring configuration and to said leg caps and said locking sleeves of said extendable-leg assemblies by said screws and said nuts, respectively, such that said scissoring-arm assemblies can contract and expand to allow said foldable table to fold and unfold, respectively, said locking sleeve having a spring-loaded button and a spring-loaded latch, said spring-loaded button having a button groove, said leg further having a latch-activating opening and a latch-deactivating edge, said spring-loaded latch pivotably attached to said locking sleeve, said spring-loaded latch for rotating into said button groove and into said latch-activating opening to latch on said spring-loaded button when said spring-loaded button is pressed, said latch-deactivating edge of said latch-activating opening for rotating said spring-loaded latch out of said button groove and out of said latch-activating opening to release said spring-loaded button when said foldable table is folded, whereby, provided is said foldable table, which:

automatically latches on said spring-loaded buttons when said spring-loaded buttons is pressed, automatically releases said spring-loaded buttons when said foldable table is folded, automatically centers said extendable leg when said extendable leg is locked, and automatically interlocks said extendable-leg assemblies when said collapse-preventing top is installed thereon.

2. The foldable table of claim 1, further, comprising a plurality of screws, said screws for screwing into said top-locking posts to strengthen said top-locking posts, respectively.

3. The foldable table of claim 2, wherein, said sheet of material having a plurality of openings and two opposite surfaces, each of said openings extending from one of said opposite surfaces to another one of said opposite surfaces.

4. The foldable table of claim 1, wherein, having four extendable-leg assemblies.

5. The foldable table of claim 1, wherein, having more than four extendable-leg assemblies.

6. The foldable table of claim 1, wherein, said collapse-preventing top being rectangular.

7. The foldable table of claim 1, wherein, said collapse-preventing top being square.

8. The foldable table of claim 1, wherein, said collapse-preventing top being round.

9. The foldable table of claim 1, wherein, each of said spring-loaded latches being a wire.

10. The foldable table of claim 1, wherein, each of said spring-loaded latches made of metallic material.

11. The foldable table of claim 1, wherein, each of said spring-loaded latches made of plasticized material.

12. A foldable table comprising:

an interlocking top, said interlocking top comprising a frame, a sheet of material, and a plurality of interlocking clamps, said sheet of material attached to said frame by sheet-attaching means, said frame having four corners each of which has an inner surface, said interlocking clamps attached to the inner surfaces of the four corners of said frame by interlocking-clamp-attaching means, respectively;

a plurality of extendable assemblies, each of said extendable assemblies comprising a locking post, a cap, a supporting member, a spring, a peg, a sleeve, a centering clamp, a spring-loaded locking means, an extendable supporting member, and a stabilizing means, said locking post integrated into said cap, said locking post for one of said interlocking clamps of said interlocking top to clamp on to interlock said extendable assemblies, said cap attached to an end of said supporting member, said supporting member having a locking opening, said spring integrated into said peg, said spring and said peg inserted into said supporting member such that the spring force of said spring pushes said peg through said locking opening, said sleeve slid on said supporting member such that said sleeve is slidably attached to said supporting member, said sleeve having a recess, said recess for said peg to be pressed into to secure said sleeve when said recess slides over said peg, said centering clamp having a plurality of predetermined clamping jaws, said leg-centering clamp having a ring-like edge and an invisible longitudinal central axis said clamping jaws molded to and along said ring-like edge of said leg-centering clamp such that said clamping jaws surround and lean inward toward said invisible central axis of said leg-centering clamp at a predetermined angle creating a force for said clamping jaws to center said extendable leg, said centering clamp attached to another end of said supporting member by centering-clamp-attaching means, said spring-loaded locking means integrated into said centering clamp, said extendable supporting member inserted into said centering clamp and said supporting member, said extendable supporting member capable of extending and retracting to adjust the height of said foldable table, said extendable supporting member having a plurality of securing openings, each of said securing openings disposed at a predetermined location on said extendable supporting member, each of said securing openings for said extendable-leg lock to be pressed into to lock said extendable supporting member at a predetermined location inside said supporting member, said stabilizing means attached to an end of said extendable supporting member by stabilizer attaching means, said stabilizing means for stabilizing said foldable table when set on a surface; and a plurality of foldable assemblies, each of said foldable assemblies comprising a plurality of foldable members and foldable attaching means, said foldable members pivotally connected to one another in a scissoring configuration and to said caps and said sleeves of said extendable assemblies by said foldable attaching means, respectively, such that said foldable assemblies can contract and expand to allow said foldable table to fold and unfold, respectively, said sleeve having a spring-loaded button and a spring-loaded latching means, said spring-loaded button having a groove, said supporting member further having a latching opening and an unlatching edge, said spring-loaded latching means pivotably attached to said sleeve, said spring-loaded latching means for rotating into said groove of said spring-loaded button and into said latching opening to latch on said spring-loaded button when said spring-loaded button is pressed, said unlatching edge of said latching opening for rotating said spring-loaded latching means out of said groove of said spring-loaded button and out of said latching opening to release said spring-loaded button when said foldable table is folded, whereby, provided is said foldable table, which:

automatically latches on said spring-loaded buttons when said spring-loaded buttons are pressed, automatically releases said spring-loaded buttons when said foldable table is folded, automatically centers said extendable supporting members when said extendable supporting members are locked, and automatically interlocks said extendable assemblies when said interlocking top is installed thereon.

13. The foldable table of claim 12, further, comprising a plurality of screws, said screws for screwing into said top-locking posts to strengthen said top-locking posts, respectively.

14. The foldable table of claim 13, wherein, said sheet of material having a plurality of openings and two opposite surfaces, each of said openings extending from one of said opposite surfaces to another one of said opposite surfaces.

15. The foldable table of claim 12, wherein, each of said spring-loaded latches being a molded or stamped latch.

16. The foldable table of claim 12, wherein, each of said spring-loaded latches made of metallic material.

17. The foldable table of claim 12, wherein, each of said spring-loaded latches made of plasticized material.

18. The foldable table of claim 12, wherein, having four extendable-leg assemblies.

19. The foldable table of claim 12, wherein, having more than four extendable-leg assemblies.

20. A foldable table comprising an interlocking top, a plurality of extendable assemblies, and a plurality of foldable assemblies, said interlocking top comprising a frame, a sheet of material, and a plurality of interlocking clamps, said sheet of material attached to said frame by sheet-attaching means, said frame having four corners each of which has an inner surface, said interlocking clamps attached to the inner surfaces of the four corners of said frame by interlocking-clamp-attaching means, respectively, each of said extendable assemblies comprising a locking post, a cap, a supporting member, a spring, a peg, a sleeve, a centering clamp, a spring-loaded locking means, an extendable supporting member, and a stabilizing means, said locking post integrated into said cap, said locking post for one of said interlocking clamps of said interlocking top to clamp on to interlock said extendable assemblies, said cap attached to an end of said supporting member, said supporting member having a locking opening, said spring integrated into said peg, said spring and said peg inserted into said supporting member such that the spring force of said spring pushes said peg through said locking opening, said sleeve slid on said supporting member such that said sleeve is slidably attached to said supporting member, said sleeve having a recess, said recess for said peg to be pressed into to secure said sleeve when said recess slides over said peg, said centering clamp having a plurality of predetermined clamping jaws, said leg-centering clamp having a ring-like edge and an invisible longitudinal central axis, said clamping jaws molded to and along said ring-like edge of said leg-centering clamp such that said clamping jaws surround and lean inward toward said invisible central axis of said leg-centering clamp at a predetermined angle creating a force for said clamping jaws to center said extendable leg, said centering clamp attached to another end of said supporting member by centering-clamp-attaching means, said spring-loaded locking means integrated into said centering clamp, said extendable supporting member inserted into said centering clamp and said supporting member, said extendable supporting member capable of extending and retracting to adjust the height of said foldable table, said extendable supporting member having a plurality of securing openings, each of said securing openings disposed at a predetermined location on said extendable supporting member, each of said securing openings for said extendable-leg lock to be pressed into to lock said extendable supporting member at a predetermined location inside said supporting member, said stabilizing means attached to an end of said extendable supporting member by stabilizer attaching means, said stabilizing means for stabilizing said foldable table when set on a surface, each of said foldable assemblies comprising a plurality of foldable members and foldable attaching means, said foldable members pivotally connected to one another in a scissoring configuration and to said caps and said sleeves of said extendable assemblies by said foldable attaching means, respectively, such that said foldable assemblies can contract and expand to allow said foldable table to fold and unfold, respectively, said sleeve having a spring-loaded button and a spring-loaded latching means, said spring-loaded button having a groove, said supporting member further having a latching opening and a unlatching edge, said spring-loaded latching means pivotably attached to said sleeve, said spring-loaded latching means for rotating into said groove of said spring-loaded button and into said latching opening to latch on said spring-loaded button when said spring-loaded button is pressed, said unlatching edge of said latching opening for rotating said spring-loaded latching means out of said groove of said spring-loaded button and out of said latching opening to release said spring-loaded button when said foldable table is folded, whereby, provided is said foldable table, which automatically latches on said spring-loaded buttons when said spring-loaded buttons are pressed, automatically releases said spring-loaded buttons when said foldable table is folded, automatically centers said extendable supporting members when said extendable supporting members are locked, and automatically interlocks said extendable assemblies when said interlocking top is installed thereon.

* * * * *